US010756473B2

(12) United States Patent
Tanaka et al.

(10) Patent No.: US 10,756,473 B2
(45) Date of Patent: Aug. 25, 2020

(54) CONNECTION TERMINAL

(71) Applicant: Yazaki Corporation, Tokyo (JP)

(72) Inventors: Yasuhiro Tanaka, Shizuoka (JP); Hiroki Kitagawa, Shizuoka (JP); Kengo Machida, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/560,991

(22) Filed: Sep. 4, 2019

(65) Prior Publication Data

US 2020/0091645 A1 Mar. 19, 2020

(30) Foreign Application Priority Data

Sep. 14, 2018 (JP) ..... 2018-172817

(51) Int. Cl.
*H01R 13/42* (2006.01)
*H01R 13/62* (2006.01)

(52) U.S. Cl.
CPC ..... *H01R 13/42* (2013.01); *H01R 13/62* (2013.01)

(58) Field of Classification Search
CPC ..... H01R 13/42; H01R 13/62
See application file for complete search history.

(56) References Cited

U.S. PATENT DOCUMENTS 3,120,989 A * 2/1964 Solorow ..... H01R 13/187 439/843
7,249,983 B2 * 7/2007 Meyer ..... H01R 13/111 439/878
7,591,694 B2 * 9/2009 Osada ..... H01R 4/185 439/852
7,789,722 B2 9/2010 Shimizu et al.
9,748,685 B2 * 8/2017 Oba ..... H01R 4/023
10,122,109 B1 * 11/2018 Hirakawa ..... H01R 13/113
2012/0083167 A1 4/2012 Kimura
2016/0020541 A1 * 1/2016 Takamura ..... H01R 13/2407 439/816
2016/0079686 A1 3/2016 Shinmi
(Continued)

FOREIGN PATENT DOCUMENTS

EP 2 590 268 A1 5/2013
JP 2002-015803 A 1/2002
(Continued)

*Primary Examiner* — Briggitte R. Hammond
(74) *Attorney, Agent, or Firm* — Kenealy Vaidya LLP

(57) ABSTRACT

A connection terminal includes a female connection body having a housing space, a male connection body inserted into the housing space to a fitting completion position, and an elastic member supported by an inner wall surface of the female connection body surrounding the housing space, having contact point portions contacting an outer wall surface of the male connection body, and pressing the male connection body by the contact point portions. The female connection body has far-side protruding portions and inlet-side protruding portions. The outer wall surface of the male connection body has at least one of first recessed portions formed at portions facing the inlet-side protruding portions when the male connection body is inserted into the housing space and a second recessed portion formed at a portion facing the contact point portion when the male connection body is inserted into the housing space.

8 Claims, 13 Drawing Sheets

(56) References Cited

U.S. PATENT DOCUMENTS

| | | | | |
|---|---|---|---|---|
| 2016/0181706 | A1* | 6/2016 | Nakano | H01R 13/187<br>439/877 |
| 2018/0337479 | A1* | 11/2018 | Machida | H01R 13/111 |

FOREIGN PATENT DOCUMENTS

| | | | |
|---|---|---|---|
| JP | 2002-280495 | A | 9/2002 |
| JP | 2013-89309 | A | 5/2013 |
| JP | 2016-119292 | A | 6/2016 |

* cited by examiner

CONNECTION TERMINAL

CROSS-REFERENCE TO RELATED APPLICATION(S)

The present application claims priority to and incorporates by reference the entire contents of Japanese Patent Application No. 2018-172817 filed in Japan on Sep. 14, 2018.

BACKGROUND OF THE INVENTION

1. Field of the Invention

The present invention relates to a connection terminal.

2. Description of the Related Art

A connection terminal including a female connection body, a male connection body inserted into a housing space of the female connection body and electrically connected to the female connection body, and an elastic member configured to bias, in the housing space, the male connection body toward a protruding portion formed on an inner wall surface of the female connection body has been known. In such a connection terminal, holding force for holding the male connection body in the housing space is ensured by the protruding portion and the elastic member.

For example, Japanese Patent Application Laid-open No. 2016-119292 discloses a connector including a male terminal, a female terminal having a tube portion into which the male terminal is inserted, and an elastic member incorporated into the tube portion of the female terminal. Multiple protruding portions protruding inward are formed on an inner wall of the tube portion of the female terminal, and the elastic member biases the male terminal inserted into the tube portion toward a multiple-protruding-portion side. According to the connector of Japanese Patent Application Laid-open No. 2016-119292, motion of the male terminal relative to the female terminal due to vibration applied to the connector can be reduced.

For the connection terminal, it has been demanded that holding force for holding the male connection body be ensured while insertion force upon insertion of the male connection body into the housing space of the female connection body be suppressed low.

SUMMARY OF THE INVENTION

An object of the present invention is to provide a connection terminal configured so that holding force for holding a male connection body can be ensured while insertion force upon insertion of the male connection body into a housing space of a female connection body can be suppressed low.

In order to achieve the above mentioned object, a connection terminal according to one aspect of the present invention includes a tubular female connection body having conductivity and having a housing space extending along an axial direction; a male connection body having conductivity and inserted into the housing space to a fitting completion position along the axial direction; and an elastic member supported by an inner wall surface of the female connection body surrounding the housing space, having a contact point portion contacting an outer wall surface of the male connection body, and pressing the male connection body by the contact point portion, wherein the female connection body has a far-side protruding portion protruding from a position of the inner wall surface on a far side in an insertion direction with respect to the contact point portion, and an inlet-side protruding portion protruding from a position of the inner wall surface on an inlet side in the insertion direction with respect to the contact point portion, the far-side protruding portion and the inlet-side protruding portion support the outer wall surface of the male connection body at the fitting completion position against pressing force of the elastic member, the outer wall surface of the male connection body has at least one of a first recessed portion formed at a portion facing the inlet-side protruding portion when the male connection body is inserted into the housing space and a second recessed portion formed at a portion facing the contact point portion when the male connection body is inserted into the housing space, the first recessed portion is, at the outer wall surface of the male connection body, formed along the insertion direction on a front side in the insertion direction with respect to a position facing the inlet-side protruding portion at the fitting completion position, and the second recessed portion is, at the outer wall surface of the male connection body, formed along the insertion direction on the front side in the insertion direction with respect to the position facing the contact point portion at the fitting completion position.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, a connection terminal according to an embodiment of the present invention will be described in detail with reference to the drawings. Note that this invention is not limited by this embodiment. Moreover, components of the embodiment below include components easily arrived by those skilled in the art or substantially-identical components.

Embodiment

Figure 1:
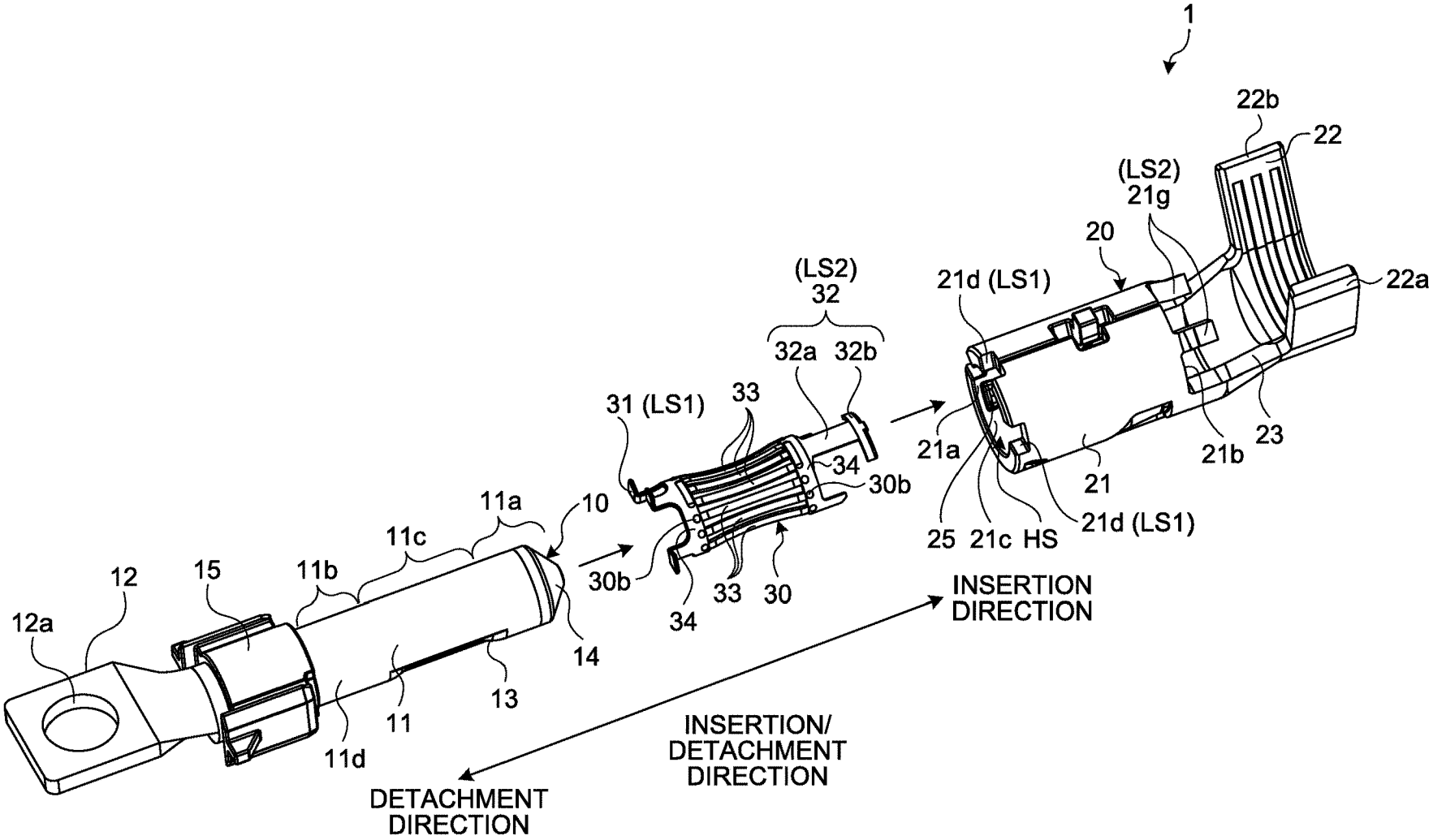
FIG. 1 is an exploded perspective view illustrating a connection terminal according to an embodiment.
Figure 2:
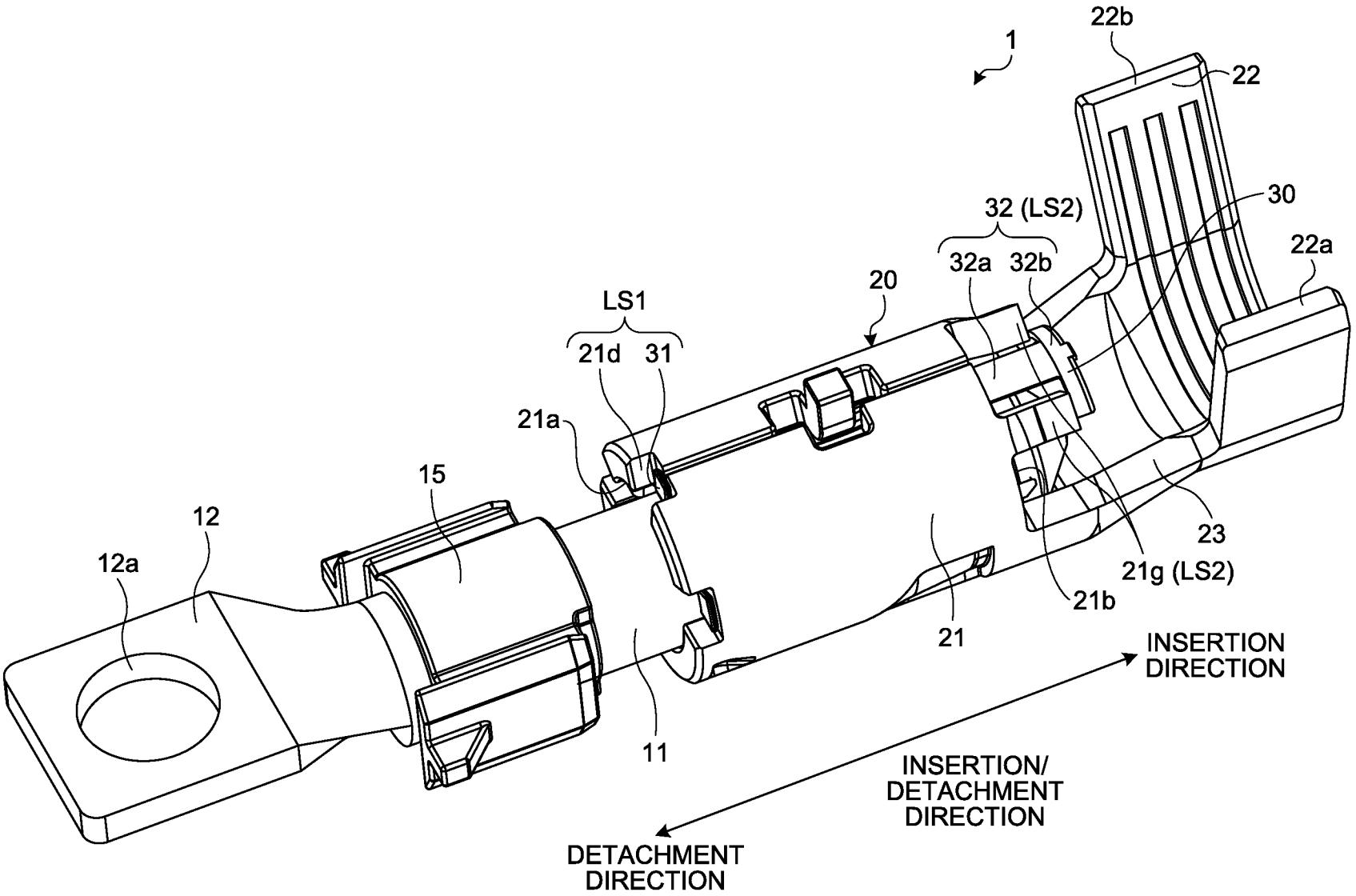
FIG. 2 is a perspective view illustrating the connection terminal according to the embodiment.
Figure 3:
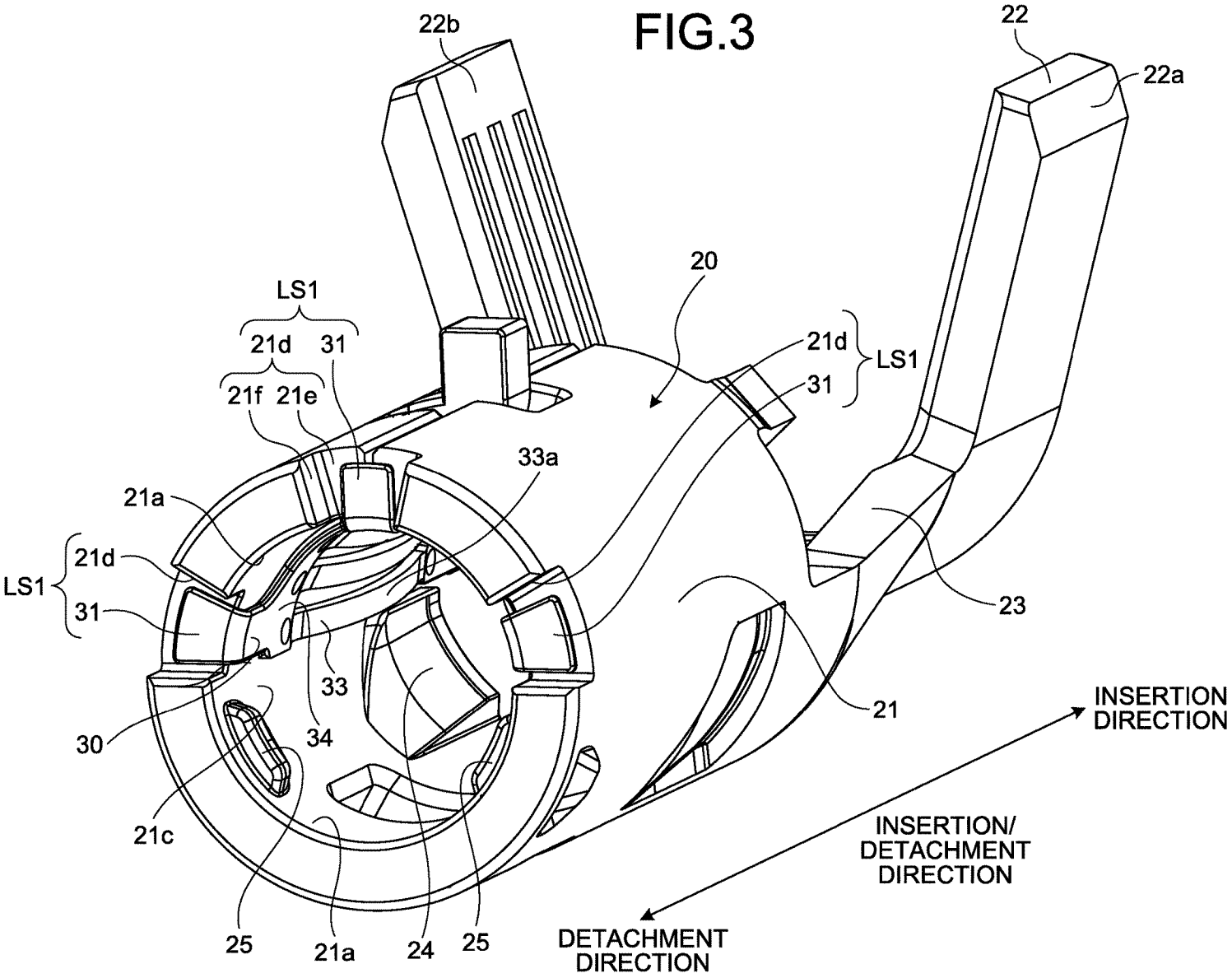
FIG. 3 is a perspective view illustrating a female terminal of the embodiment.
Figure 4:
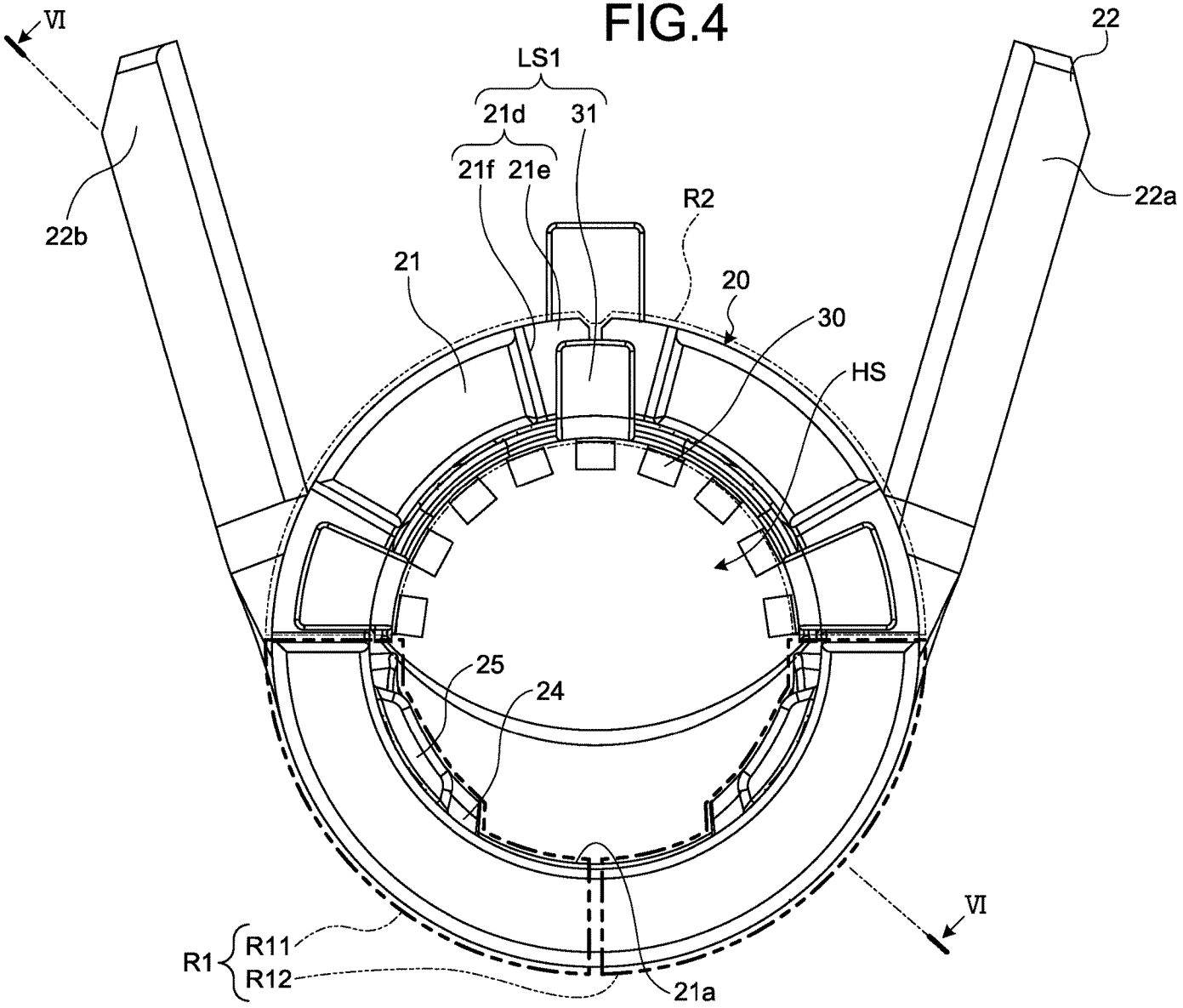
FIG. 4 is a plan view illustrating the female terminal of the embodiment.
Figure 5:
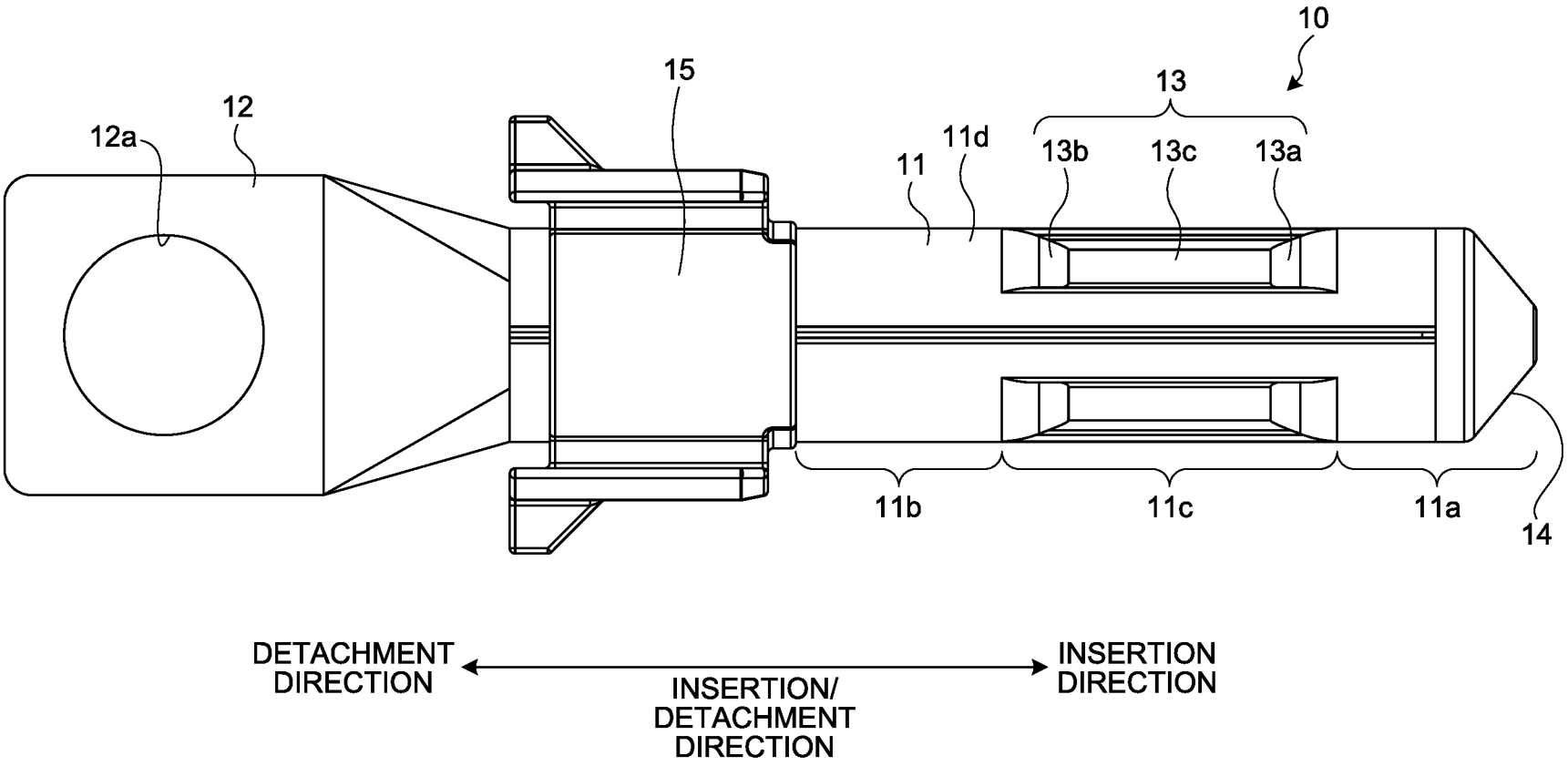
FIG. 5 is a plan view illustrating a male terminal of the embodiment.
Figure 6:
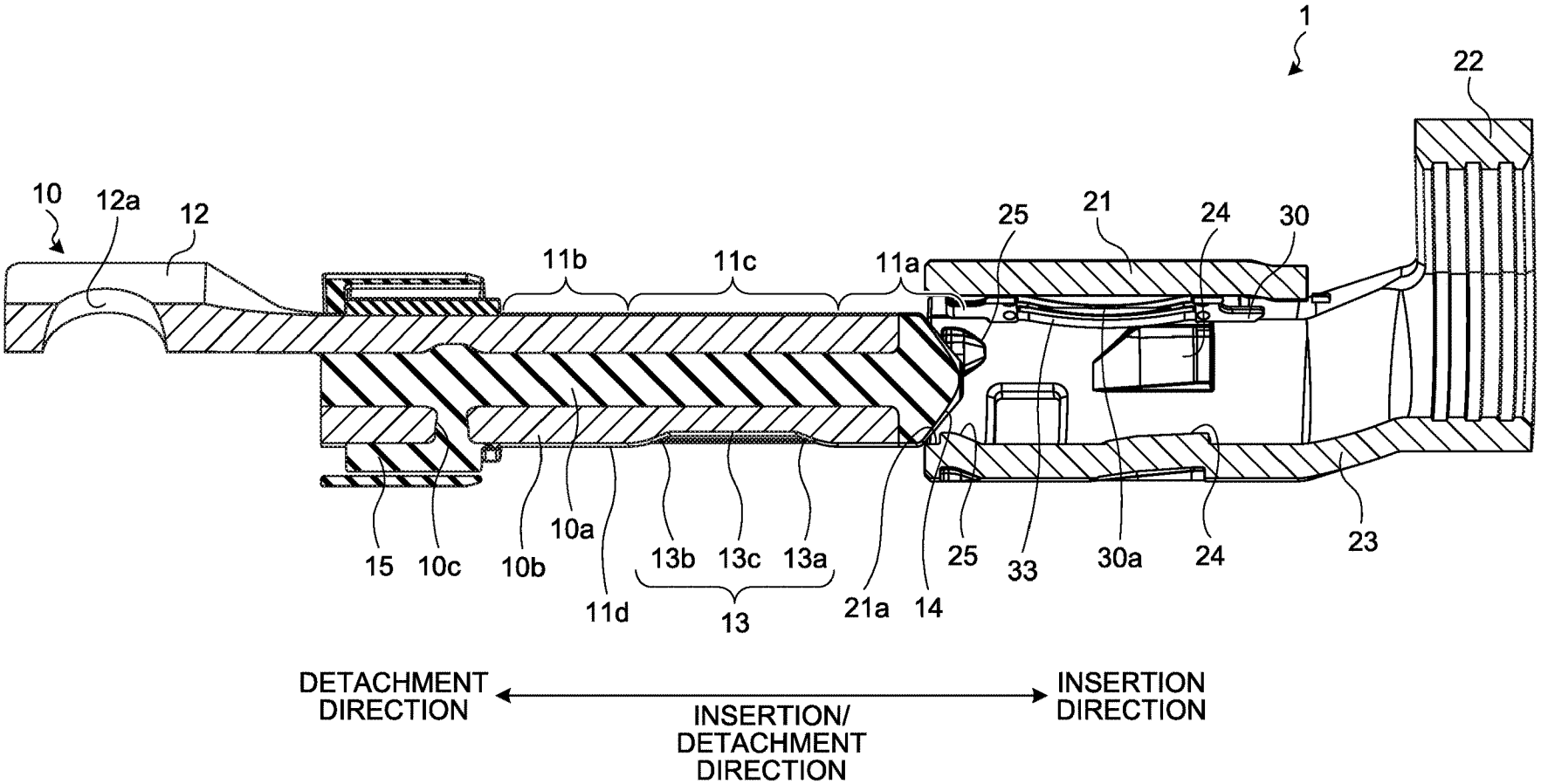
FIG. 6 is a sectional view illustrating the process of inserting a male connection body into a housing space in the embodiment.
Figure 7:
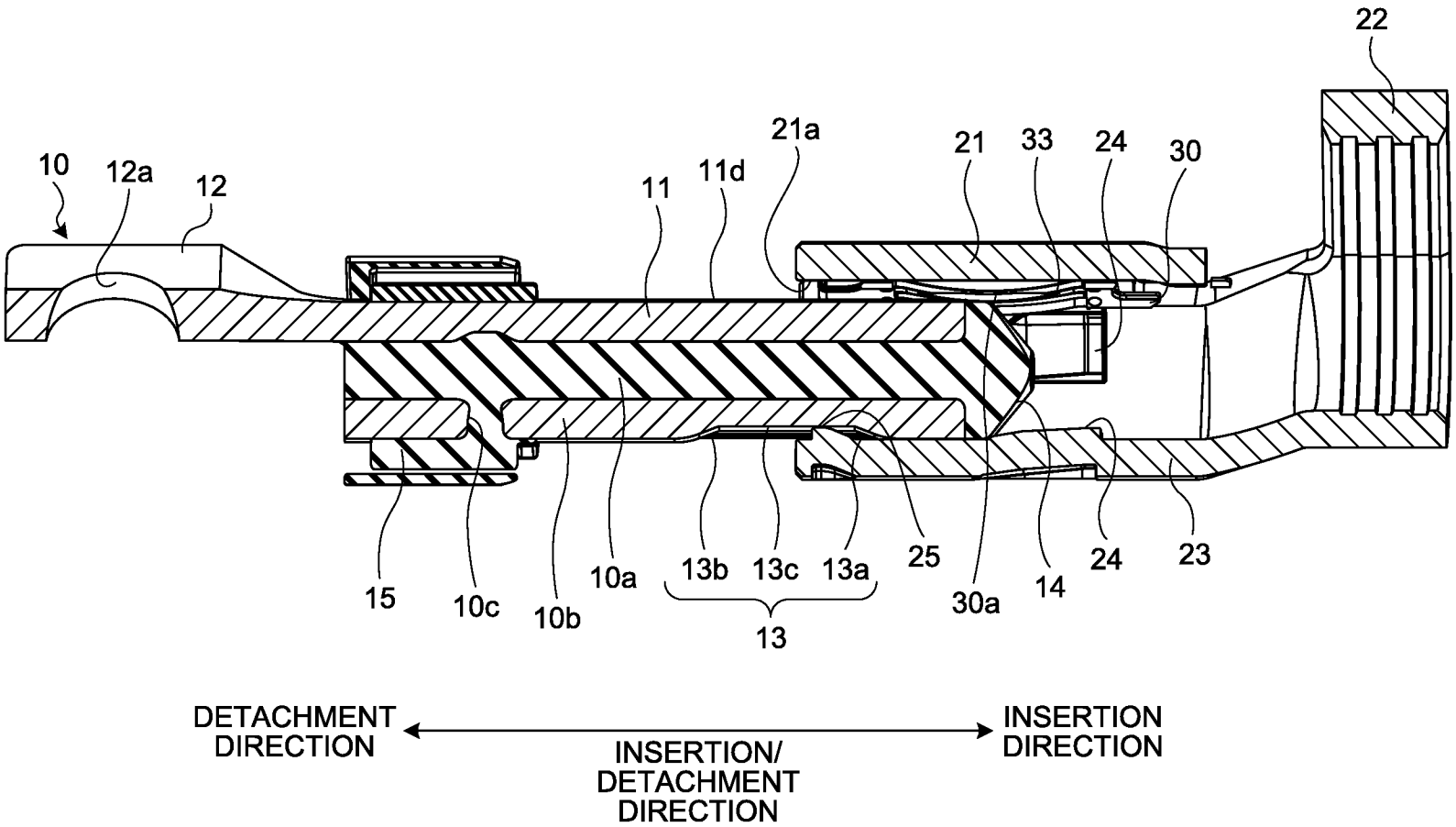
FIG. 7 is a sectional view illustrating the process of inserting the male connection body into the housing space in the embodiment.
Figure 8:
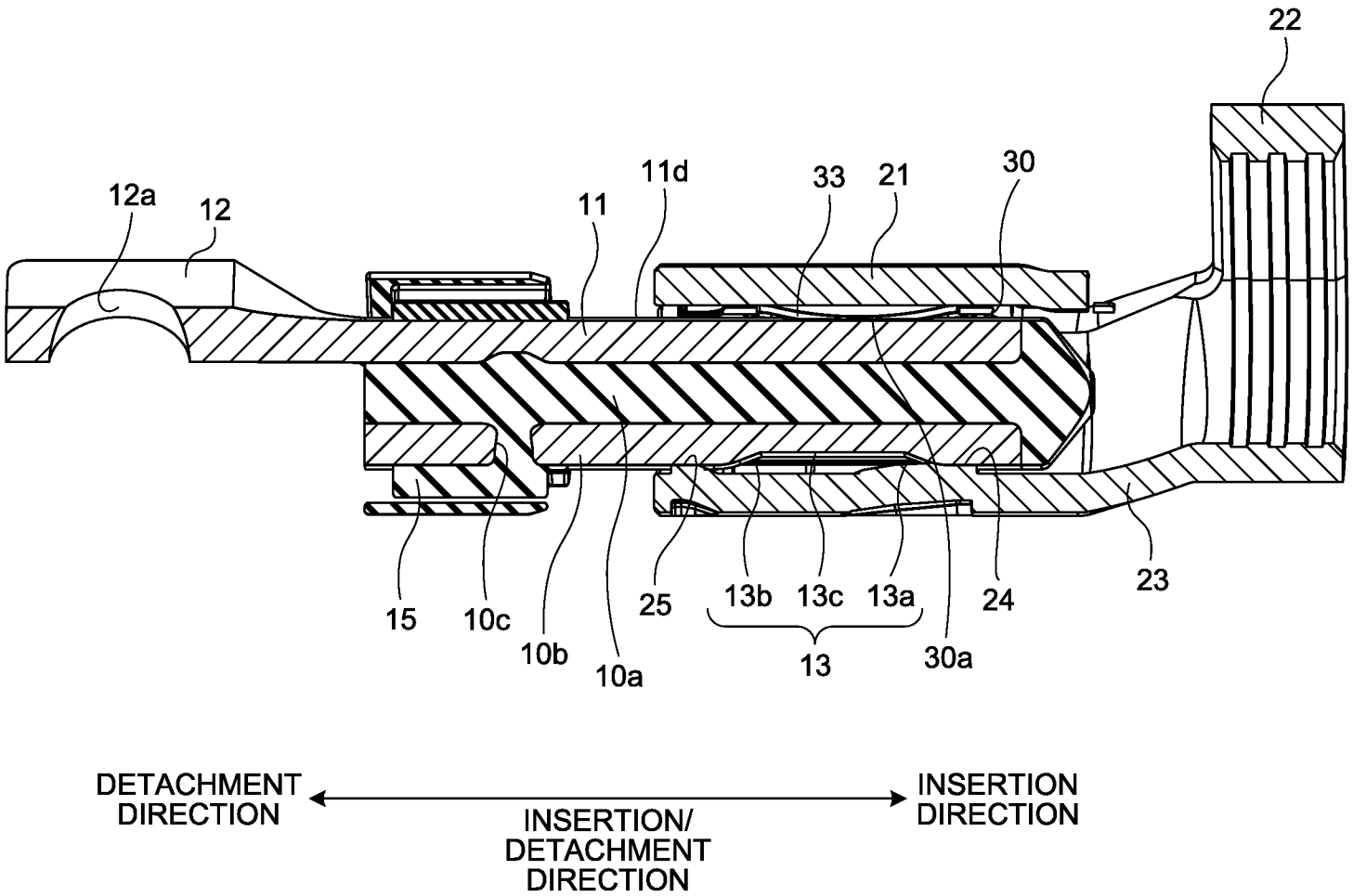
FIG. 8 is a sectional view illustrating the process of inserting the male connection body into the housing space in the embodiment.
Figure 9:
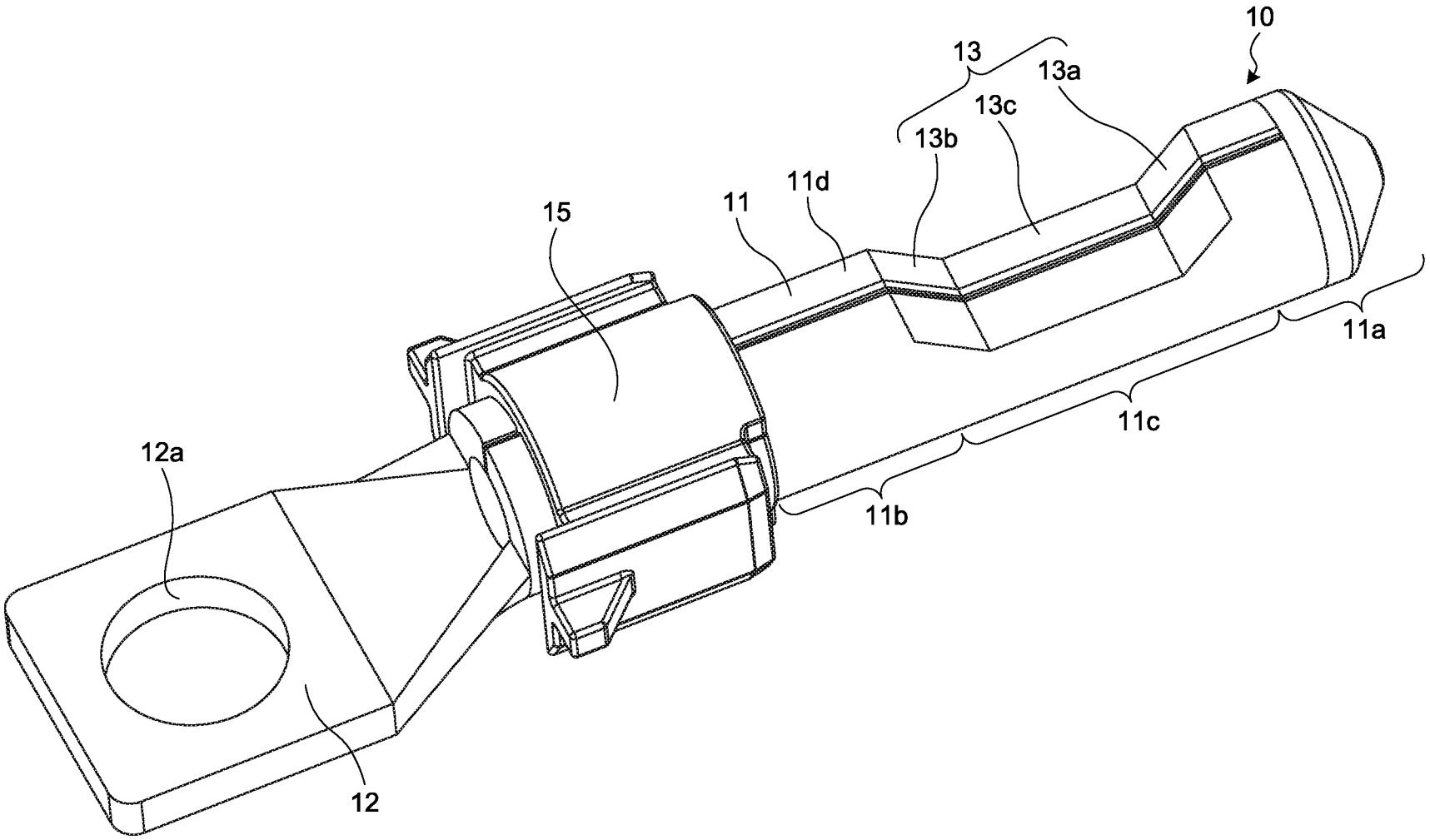
FIG. 9 is a perspective view illustrating another example of the male terminal of the embodiment.

The embodiment will be described with reference to FIGS. 1 to 8. The embodiment relates to a connection terminal. FIG. 1 is an exploded perspective view illustrating the connection terminal according to the embodiment. FIG. 2 is a perspective view illustrating the connection terminal according to the embodiment. FIG. 3 is a perspective view illustrating a female terminal of the embodiment. FIG. 4 is a plan view illustrating the female terminal of the embodiment. FIG. 5 is a plan view illustrating a male terminal of the embodiment. FIG. 6 is a sectional view illustrating the process of inserting a male connection body into a housing space in the embodiment. FIG. 7 is a sectional view illustrating the process of inserting the male connection body into the housing space in the embodiment. FIG. 8 is a sectional view illustrating the process of inserting the male connection body into the housing space in the embodiment. FIG. 9 is a perspective view illustrating another example of the male terminal of the embodiment. Note that FIGS. 6 to 8 illustrate a section corresponding to a VI-VI section illustrated in FIG. 4.

As illustrated in FIG. 1, a connection terminal 1 of the present embodiment includes a male terminal 10, a female terminal 20, and an elastic member 30.

The male terminal 10 is made of a conductive metal material. The male terminal 10 has a male connection body 11, a terminal connection body 12, and a fixing portion 15.

In the male terminal 10, the male connection body 11 is a portion inserted into a later-described housing space HS of the female terminal 20 and electrically connected to the female terminal 20. The male connection body 11 is, for example, formed in a columnar shape. In the embodiment, the male connection body 11 is formed in a circular columnar shape. In the embodiment, an axial direction of the male connection body 11 is an insertion and removal direction for the female terminal 20. Note that in the specification, a direction which is along the insertion and removal direction and in which the male connection body 11 is inserted into the housing space HS of the female terminal 20 will be referred to as an "insertion direction," and a direction in which the male connection body 11 is removed from the female terminal 20 will be referred to as a "removal direction."

The terminal connection body 12 is formed in a flat plate shape. The terminal connection body 12 has, for example, an insertion hole 12*a* into which a terminal screw is to be inserted. The insertion hole 12*a* is formed in the vicinity of the center of the flat plate-shaped terminal connection body 12.

In the embodiment, the male connection body 11 is formed in such a manner that the periphery of an insulating portion 10*a* extending in the axial direction is covered with a conductive tubular member 10*b* (see FIG. 6). The male connection body 11 has a tip end portion 14 on a front end side (a front side in the insertion direction). The tip end portion 14 of the embodiment is formed by a portion of the insulating portion 10*a* exposed through a front end side end portion of the tubular member 10*b*. The tip end portion 14 is formed in a tapered shape, and is formed such that the diameter thereof increases from the front end side to a back end side (a back side in the insertion direction). At an outer wall surface 11*d* of the male connection body 11, the tubular member 10*b* forms an outer wall surface electrically connected to a female connection body 21. At the outer wall surface 11*d* of the male connection body 11, a back end side outer wall surface of the tip end portion 14 is formed flush with the outer wall surface of the tubular member 10*b*. The terminal connection body 12 protrudes in the axial direction from one end portion of the tubular member.

The fixing portion 15 is arranged between the male connection body 11 and the terminal connection body 12. The fixing portion 15 has insulation properties, and is provided to cover the tubular member 10*b* in the vicinity of a base end portion of the terminal connection body 12. A hole 10*c* is formed at a portion of the tubular member 10*b* covered with the fixing portion 15, and the fixing portion 15 is integrated with the insulating portion 10*a* of the male connection body 11 through the hole 10*c* (see FIG. 6). With this configuration, the fixing portion 15 restricts shift of the position of the tubular member 10*b* relative to the insulating portion 10*a*.

As illustrated in FIG. 1, the female terminal 20 has the female connection body 21, an electric wire connection body 22, and a coupling body 23. The female connection body 21 is formed in a tubular body. In the embodiment, the female connection body 21 is formed in a cylindrical shape. The female connection body 21 has the housing space HS surrounded by an inner wall surface 21*c* of the female connection body 21. The housing space HS extends along an axial direction of the female connection body 21. The housing space HS is formed in a shape (e.g., a tubular shape) corresponding to the outer shape of the male connection body 11. In the embodiment, the housing space HS is formed in a circular columnar shape. Both ends of the female connection body 21 in the axial direction open, and communicate the housing space HS and an external space with each other. As illustrated in FIGS. 1 and 2, one end opening (hereinafter referred to as a "first opening 21*a*") is utilized as an inlet for insertion of the male connection body 11. Moreover, in the embodiment, the male connection body 11 inserted through the first opening 21*a* protrudes from the other end opening (hereinafter referred to as a "second opening 21*b*") as illustrated in FIG. 2.

The electric wire connection body 22 is a portion electrically connected to a conductive portion of an electric wire (not illustrated). The electric wire connection body 22 is electrically connected to the conductive portion of the electric wire by pressure bonding such as swaging. In the embodiment, the electric wire connection body 22 has a pair of barrel piece portions 22*a*, 22*b* facing each other. Each of the barrel piece portions 22*a*, 22*b* is wound around the conductive portion (a core wire) of the electric wire and is pressure-bonded, and therefore, the electric wire connection body 22 and the conductive portion of the electric wire are electrically connected to each other. Note that the electric wire connection body 22 may be a portion electrically connected to the conductive portion of the electric wire by, e.g., welding or soldering. The coupling body 23 is arranged between the female connection body 21 and the electric wire connection body 22. The coupling body 23 connects the female connection body 21 and the electric wire connection body 22 to each other. The female terminal 20 is made of a conductive metal material.

As illustrated in FIG. 3, the female terminal 20 has far-side protruding portions 24 and inlet-side protruding portions 25. The far-side protruding portions 24 and the inlet-side protruding portions 25 protrude from the inner wall surface 21*c* of the female connection body 21 in the housing space HS. The far-side protruding portion 24 and the inlet-side protruding portion 25 are members configured to hold, together with the later-described elastic member 30, the male connection body 11 inserted into the housing space HS to a fitting completion position. As illustrated in FIG. 4, the far-side protruding portions 24 and the inlet-side protruding portions 25 of the embodiment are arranged in one region R1 when the female connection body 21 is divided into two regions R1, R2 along the insertion and removal direction. The regions R1, R2 described herein are separated substantially symmetrically with respect to the center axis of the female connection body 21. That is, the regions R1, R2 are regions formed in such a manner that the female connection body is divided in half along the insertion and removal direction.

Two far-side protruding portions 24 are arranged with a spacing in a circumferential direction of the inner wall surface 21*c* in the vicinity of a second-opening-21*b*-side end portion of the female connection body 21. Moreover, two inlet-side protruding portions 25 are arranged with a spacing in the circumferential direction of the inner wall surface 21*c* in the vicinity of a first-opening-21*a*-side (inlet-side) end portion of the female connection body 21. The far-side protruding portions 24 and the inlet-side protruding portions 25 are arranged such that the single far-side protruding portion 24 and the single inlet-side protruding portion 25 are arranged in each of two regions R11, R12 formed by further division of the above-described divided region R1 into two regions along the insertion and removal direction. The regions R11, R12 are regions formed in such a manner that the region R1 is divided in half along the insertion and removal direction. When the female connection body 21 is viewed from a first opening 21*a* side, the far-side protruding portion 24 and the inlet-side protruding portion 25 are arranged overlapping with each other in the insertion and removal direction.

As illustrated in FIG. 1, the elastic member 30 of the embodiment is inserted into the housing space HS through the first opening 21*a*. The elastic member 30 has conductivity and elasticity. The elastic member 30 is arranged in the other region R2 when the female connection body 21 is divided into two regions R1, R2 along the insertion and removal direction (see FIG. 4). The elastic member 30 has male-side contact bodies 33 and two female-side contact bodies 34. The female-side contact body 34 is formed in an arc shape along the inner wall surface 21*c* of the female connection body 21. As illustrated in FIG. 1, two female-side contact bodies 34 are arranged facing each other in the insertion and removal direction. The male-side contact body 33 is a plate spring-shaped member extending in the insertion and removal direction. The male-side contact bodies 33 are arranged between two female-side contact bodies 34, and end portions of the male-side contact body 33 are each connected to the female-side contact bodies 34. In the embodiment, multiple male-side contact bodies 33 are provided between two female-side contact bodies 34 as illustrated in FIG. 3. When the elastic member 30 is arranged in the housing space HS, the multiple male-side contact bodies 33 are arranged in the circumferential direction of the inner wall surface 21*c*. The elastic member 30 is made of conductive metal with the elasticity.

In the housing space HS, the elastic member 30 is supported by the inner wall surface 21*c*. The male-side contact body 33 has a first contact point portion 30*a* contacting the outer wall surface 11*d* of the male connection body 11. Moreover, the female-side contact body 34 has multiple second contact point portions 30*b* contacting the inner wall surface 21*c* (see FIG. 1). The second contact point portion 30*b* is provided in a protrusion shape on a surface of the female-side contact body 34 facing the inner wall surface 21*c*. The male-side contact body 33 is curved such that the first contact point portion 30*a* protrudes to the center axis of the housing space HS.

The female connection body 21 and the elastic member 30 have a first stop structure LS1 and a second stop structure LS2. The first stop structure LS1 restricts position shift of the elastic member 30 relative to the female connection body 21 in the insertion direction. The second stop structure LS2 restricts position shift of the elastic member 30 relative to the female connection body 21 in the removal direction.

The first stop structure LS1 includes first stop target portions 31 provided at the elastic member 30, and first stop portions 21*d* provided at the female connection body 21. As illustrated in FIG. 2, the first stop target portion 31 is formed to protrude from the elastic member 30 to an inner wall surface 21*c* side of the female connection body 21 in a state in which the elastic member 30 is housed in the housing space HS. The first stop portion 21*d* is a portion formed in a cutout shape at a first-opening-21*a*-side end portion of the female connection body 21. When the elastic member 30 is housed in the housing space HS, the first stop target portion 31 is inserted into the first stop portion 21*d*. As illustrated in FIG. 3, the first stop portion 21*d* has a wall surface 21*e* perpendicular to the insertion direction of the male connection body 11, and a wall surface 21*f* perpendicular to a circumferential direction of the female connection body 21. The first stop portion 21*d* restricts, by the wall surface 21*e*, position shift of the elastic member 30 relative to the female connection body 21 in the insertion direction, and by the wall surface 21*f*, restricts position shift of the elastic member 30 relative to the female connection body 21 in the circumferential direction.

As illustrated in FIG. 1, the second stop structure LS2 includes a second stop target portion 32 provided at the elastic member 30, and second stop portions 21*g* provided at the female connection body 21. The second stop target portion 32 is formed at an end portion of the elastic member 30 arranged on a second opening 21*b* side. The second stop target portion 32 has a shaft portion 32*a* extending along the insertion direction and a pair of piece portions 32*b*, 32*c*. The pair of piece portions 32*b*, 32*c* are provided in an arc shape along the circumferential direction of the female connection body 21 at an end portion of the shaft portion 32*a* in an extension direction thereof. The second stop portions 21*g* are portions each protruding from the second-opening-21*b*-side end portion of the female connection body 21 to face the piece portions 32*b*, 32*c*. The second stop portions 21*g* each contact the piece portions 32*b*, 32*c* to restrict position shift of the elastic member 30 relative to the female connection body 21 in the removal direction.

As illustrated in FIG. 5, the outer wall surface 11*d* of the male connection body 11 has first recessed portions 13. The first recessed portion 13 is a portion for reducing mechanical interference of the inlet-side protruding portion 25 with the male connection body 11 when the male connection body 11 is inserted into the female connection body 21. The first recessed portion 13 is formed at a portion facing the inlet-side protruding portion 25 when the male connection body 11 is inserted into the female connection body 21. When the male connection body 11 is inserted into the housing space HS, the inlet-side protruding portion 25 passes by the first recessed portion 13.

The first recessed portion 13 of the embodiment is arranged at an intermediate portion 11*c* between a front end portion 11*a* and a back end portion 11*b* of the male connection body 11. The front end portion 11*a* is a portion of the male connection body 11, which is inserted to the fitting completion position, contacting the far-side protruding portions 24 (see FIG. 8). The front end portion 11*a* partially includes the tip end portion 14. At the male connection body 11 inserted to the fitting completion position, the front end portion 11*a* contacts the far-side protruding portions 24 at a back portion with respect to the tip end portion 14 in the insertion direction. The back end portion 11*b* is a portion of the male connection body 11, which is inserted to the fitting completion position, contacting the inlet-side protruding portions 25 (see FIG. 8).

The first recessed portion 13 of the embodiment is formed in a groove shape along the insertion direction. The first recessed portion 13 is formed corresponding to the inlet-side protruding portion 25, and in the embodiment, two first recessed portions 13 are formed at the intermediate portion 11*c* of the male connection body 11. Two first recessed portions 13 are arranged in a circumferential direction of the male connection body 11. The width of the first recessed portion 13 is formed with such a width that the inlet-side protruding portion 25 enters the first recessed portion 13.

The first recessed portion 13 has a first inclined surface 13*a*, a second inclined surface 13*b*, and a bottom surface 13*c*. The bottom surface 13*c* is a surface recessed with respect to a surface of the outer wall surface 11*d* of the male connection body 11 surrounding the first recessed portion 13. The amount of recess of the bottom surface 13*c* with respect to the surface surrounding the first recessed portion 13 corresponds to the height of protrusion of the inlet-side protruding portion 25 from the inner wall surface 21*c*. The amount of recess of the bottom surface 13*c* in the embodiment is at the same level as the height of protrusion of the inlet-side protruding portion 25 from the inner wall surface 21*c*. The bottom surface 13*c* is arranged between the first inclined surface 13*a* and the second inclined surface 13*b*. The first inclined surface 13*a* is arranged on a front end portion 11*a* side with respect to the bottom surface 13*c*. The second inclined surface 13*b* is arranged on a back end portion 11*b* side with respect to the bottom surface 13*c*. The first inclined surface 13*a* extends along the insertion and removal direction, and is inclined from a front-end-portion-11*a*-side end portion of the bottom surface 13*c* to the outer wall surface 11*d* of the front end portion 11*a*. The second inclined surface 13*b* extends along the insertion and removal direction, and is inclined from a back-end-portion-11*b*-side end portion of the bottom surface 13*c* to the outer wall surface 11*d* of the back end portion 11*b*.

The process of inserting the male connection body 11 into the housing space HS in the embodiment will be described with reference to FIGS. 6 to 8.

As illustrated in FIG. 6, the male connection body 11 is inserted into the housing space HS along the axial direction of the female connection body 21 through the first opening 21*a* (an inlet side) of the female connection body 21. As illustrated in FIG. 7, the front end portion 11*a* of the male connection body 11 enters the housing space HS over the inlet-side protruding portions 25. The first recessed portions 13 of the embodiment are formed in an area including positions facing the inlet-side protruding portions 25 when the first contact point portions 30*a* start contacting the outer wall surface 11*d* of the male connection body 11 inserted into the housing space HS. After the front end portion 11*a* has moved over the inlet-side protruding portions 25, the inlet-side protruding portions 25 are guided into the first recessed portions 13 along the first inclined surfaces 13*a* of the first recessed portions 13. When each inlet-side protruding portion 25 is positioned in the first recessed portion 13, the outer wall surface 11*d* of the male connection body 11 starts contacting the first contact point portion 30*a*.

As the male connection body 11 advances in the housing space HS in the insertion direction, each inlet-side protruding portion 25 moves relative to the male connection body 11 along the first inclined surface 13*a*, the bottom surface 13*c*, and the second inclined surface 13*b* in the first recessed portion 13. By such relative movement, each inlet-side protruding portion 25 passes by the first recessed portion 13. The first recessed portion 13 is, at the outer wall surface 11*d* of the male connection body 11, formed along the insertion direction in an area on the front side (the front end portion 11*a* side) in the insertion direction with respect to a position facing the inlet-side protruding portion 25 and the back side (a terminal connection body 12 side) in the insertion direction with respect to a position facing the far-side protruding portion 24 at the fitting completion position. In the embodiment, after the male connection body 11 has moved over the far-side protruding portions 24, the male connection body 11 further advances along the insertion direction in the housing space HS, and therefore, each inlet-side protruding portion 25 passes by the first recessed portion 13.

The male connection body 11 further advances along the insertion direction in the housing space HS, and the back end portion 11*b* moves over the inlet-side protruding portions 25. As illustrated in FIG. 8, the male connection body 11 is inserted into the housing space HS to the fitting completion position. At the fitting completion position, the front end portion 11*a* of the male connection body 11 contacts the far-side protruding portions 24, and the back end portion 11*b* of the male connection body 11 contacts the inlet-side protruding portions 25. The male connection body 11 is pressed against the far-side protruding portions 24 and the inlet-side protruding portions 25 by the first contact point portions 30*a* of the elastic member 30. The far-side protruding portions 24 and the inlet-side protruding portions 25 support the outer wall surface 11*d* of the male connection body 11 against pressing force of the elastic member 30. With this configuration, the male connection body 11 is held in the housing space HS at the fitting completion position.

Note that in the embodiment, description has been made using an example where the first recessed portions 13 are formed at the intermediate portion 11*c*, but the present invention is not limited to such an example. For example, the first recessed portions 13 may be, at the outer wall surface 11*d* of the male connection body 11, formed along the insertion direction on the front side in the insertion direction with respect to the positions facing the inlet-side protruding portions 25 at the fitting completion position. Thus, the first recessed portion 13 may be formed from the intermediate portion 11*c* to a front end of the front end portion 11*a* along the insertion direction.

In this case, the height of protrusion of the far-side protruding portion 24 may be set greater than the height of protrusion of the inlet-side protruding portion 25 so that the far-side protruding portions 24 can hold, together with the inlet-side protruding portions 25 and the elastic member 30, the male connection body 11 at the fitting completion position. For example, the far-side protruding portions 24 contact portions of the front end portion 11*a* provided with the first recessed portions 13, and together with the inlet-side protruding portion 25 and the elastic member 30, hold the male connection body 11 at the fitting completion position.

Moreover, in a case where each first recessed portion 13 is formed from the intermediate portion 11*c* to the front end of the front end portion 11*a* along the insertion direction, when the female connection body 21 is viewed from the first opening 21*a* side, the inlet-side protruding portions 25 and the far-side protruding portions 24 may be arranged not overlapping with each other in the insertion direction. With such arrangement, when the male connection body 11 is inserted into the housing space HS, the far-side protruding portions 24 do not fall into the first recessed portions 13, and together with the inlet-side protruding portions 25 and the elastic member 30, can hold the male connection body 11 at the fitting completion position. For example, when the female connection body 21 is viewed from the first opening 21*a* side, two inlet-side protruding portions 25 arranged apart from each other in the circumferential direction of the inner wall surface 21*c* may be positioned between two far-side protruding portions 24 arranged apart from each other in the circumferential direction of the inner wall surface 21*c*.

Note that in the embodiment, the housing space HS of the female connection body 21 has been described as a circular columnar space, but the present invention is not limited to above. For example, the housing space HS may be a triangular columnar space or a quadrangular columnar space. Moreover, the above-described male connection body 11 has been described as a circular columnar member, but the present invention is not limited to above. The male connection body 11 may be, for example, a triangular columnar member or a quadrangular columnar member as long as the male connection body 11 is in a shape insertable into the housing space HS and fittable in the female connection body 21.

Note that as illustrated in FIG. 9, the first recessed portion 13 may be formed as a cutout-shaped recessed portion formed by cutting out of the male connection body 11 along a width direction (a radial direction). In this case, when the male connection body 11 is inserted into the housing space HS, two inlet-side protruding portions 25 pass by the single first recessed portion 13.

Variation of Embodiment

Figure 10:
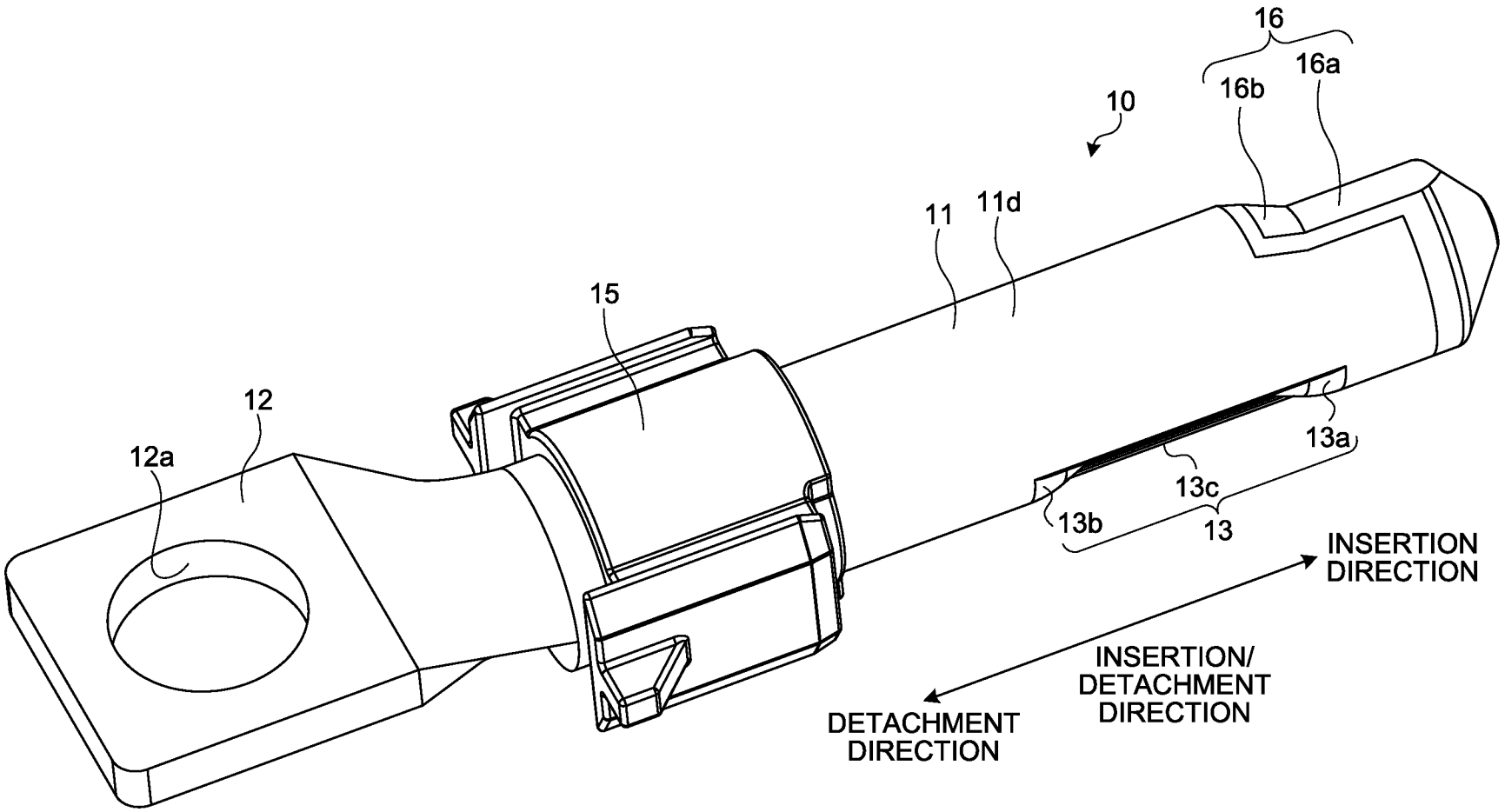
FIG. 10 is a perspective view illustrating a male terminal of a variation of the embodiment.
Figure 11:
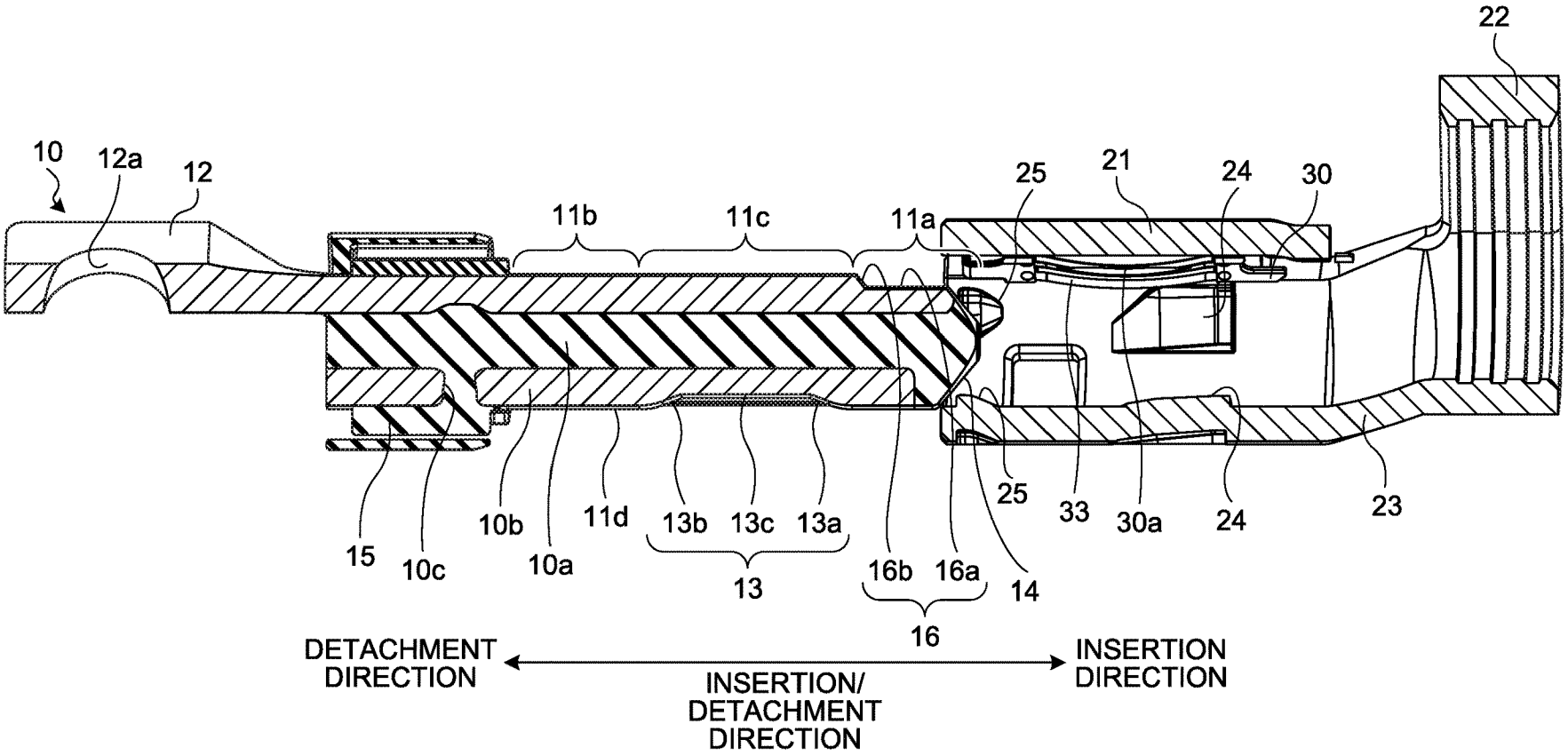
FIG. 11 is a sectional view illustrating the process of inserting a male connection body into a housing space in the variation of the embodiment.
Figure 12:
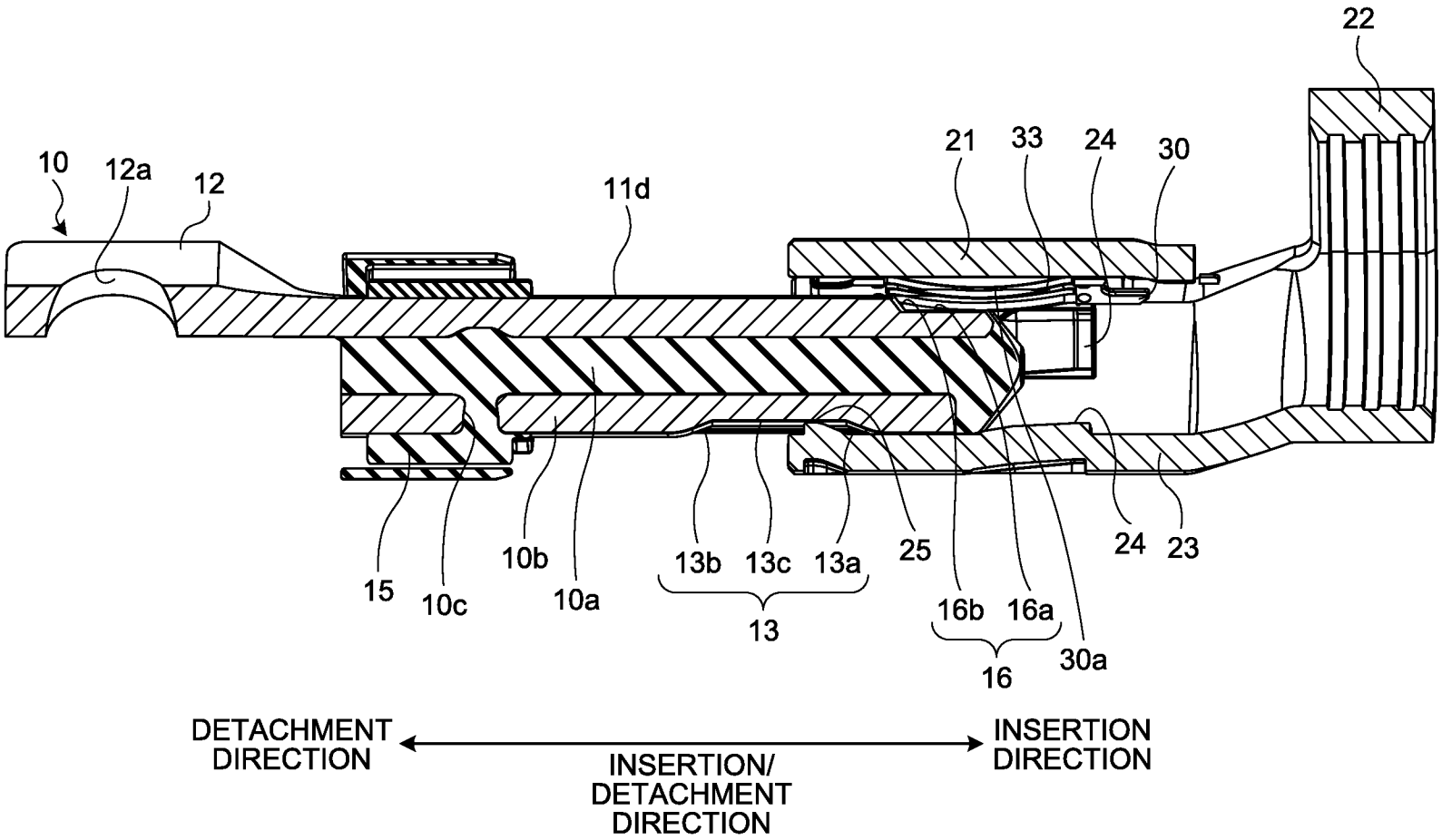
FIG. 12 is a sectional view illustrating the process of inserting the male connection body into the housing space in the variation of the embodiment.
Figure 13:
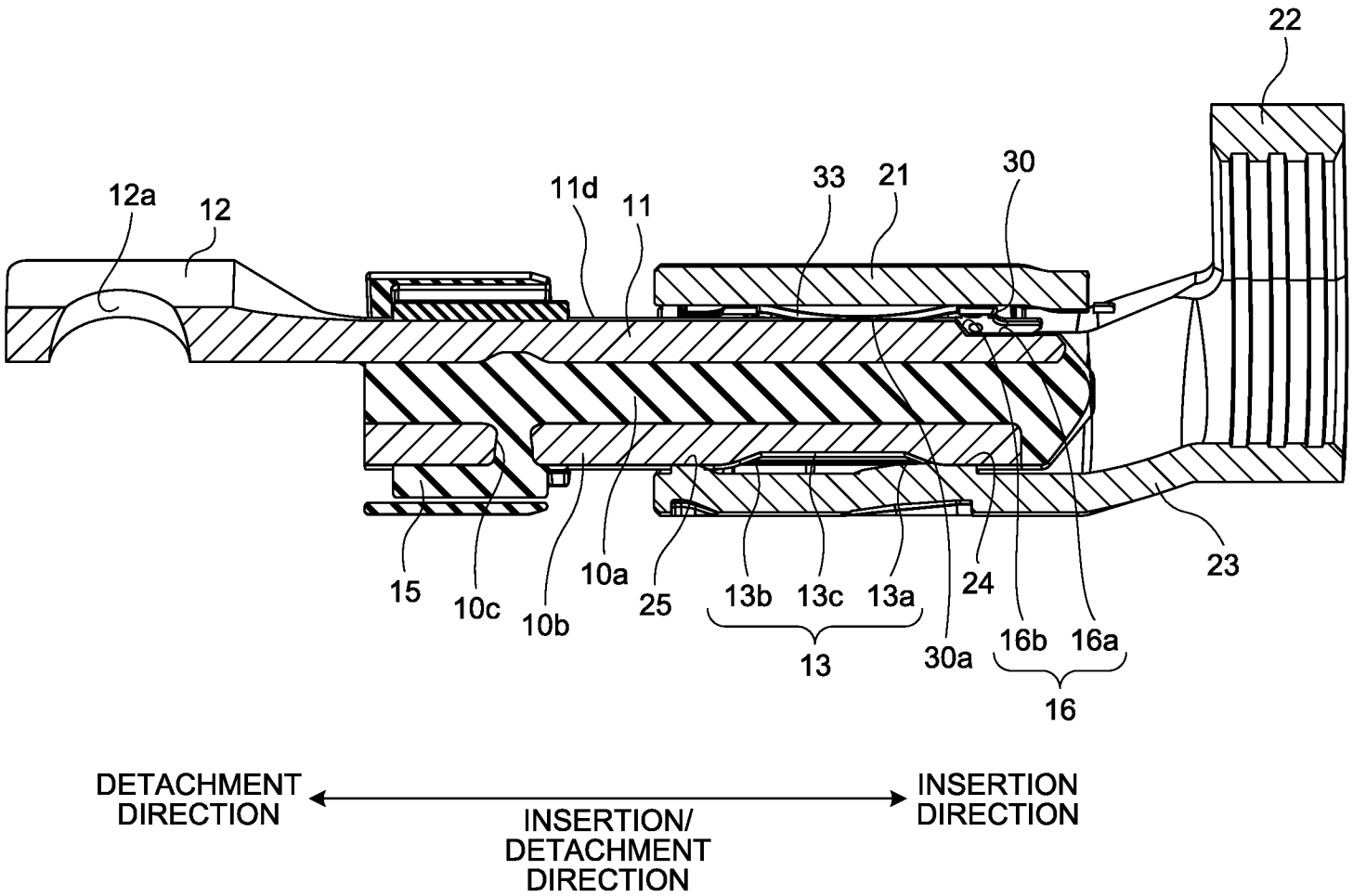
FIG. 13 is a sectional view illustrating the process of inserting the male connection body into the housing space in the variation of the embodiment.

A variation of the embodiment will be described with reference to FIGS. 10 to 13. The variation of embodiment relates to the connection terminal. In the variation of the embodiment, the same reference numerals are used to represent components having functions similar to those described above in the embodiment, and overlapping description will be omitted. FIG. 10 is a perspective view illustrating a male terminal of the variation of the embodiment. FIG. 11 is a sectional view illustrating the process of inserting the male connection body into the housing space in the variation of the embodiment. FIG. 12 is a sectional view illustrating the process of inserting the male connection body into the housing space in the variation of the embodiment. FIG. 13 is a sectional view illustrating the process of inserting the male connection body into the housing space in the variation of the embodiment. FIGS. 11 to 13 are the sectional views each corresponding to FIGS. 6 to 8 in the above-described embodiment.

As illustrated in FIG. 10, in the present variation, the outer wall surface 11*d* of the male connection body 11 has a second recessed portion 16. The second recessed portion 16 is, at the outer wall surface 11*d* of the male connection body 11, formed along the insertion direction on the front side in the insertion direction with respect to a position facing the first contact point portion 30*a* at the fitting completion position. In the variation of embodiment, the second recessed portion 16 is formed at the front end portion 11*a*. The second recessed portion 16 is formed to the front end at the outer wall surface 11*d* of the male connection body 11. The second recessed portion 16 has a bottom surface 16*a* and an inclined surface 16*b*.

The bottom surface 16*a* is a surface recessed with respect to the outer wall surface 11*d* at the periphery of the second recessed portion 16. The inclined surface 16*b* is a surface inclined from an intermediate-portion-11*c*-side end portion of the bottom surface 16*a* to the outer wall surface 11*d* at the periphery of the second recessed portion 16.

As illustrated in FIG. 11, the male connection body 11 is, as in the above-described embodiment, inserted into the housing space HS along the axial direction of the female connection body 21 through the first opening 21*a* (the inlet side) of the female connection body 21.

As illustrated in FIG. 12, the front end portion 11*a* of the male connection body 11 enters the housing space HS over the inlet-side protruding portions 25. In the present variation, the second recessed portion 16 is formed at a portion facing the first contact point portion 30*a* until the inlet-side protruding portions 25 are positioned in the first recessed portions 13 after the front end portion 11*a* has moved over the inlet-side protruding portions 25. As the male connection body 11 advances along the insertion direction, the first contact point portion 30*a* passes toward an intermediate portion 11*c* side along the bottom surface 16*a* and the inclined surface 16*b* in the second recessed portion 16.

Thereafter, as illustrated in FIG. 13, the male connection body 11 is inserted into the housing space HS to the fitting completion position. At the fitting completion position, the male connection body 11 is held in the housing space HS by the elastic member 30, the inlet-side protruding portions 25, and the far-side protruding portions 24.

Note that in the variation, the first recessed portions 13 are not necessarily formed. Moreover, a back end portion of the second recessed portion 16 in the insertion direction may be, at the fitting completion position, formed to a position right before the position facing the first contact point portion 30*a*. That is, the second recessed portion 16 may be formed from the front end portion 11*a* to the intermediate portion 11*c* of the male connection body 11.

Summary of Embodiment and Variation of Embodiment

As described above, the connection terminal 1 according to the embodiment and the variation includes the tubular female connection body 21 having conductivity and having the housing space extending along the axial direction, the male connection body 11 having conductivity and inserted into the housing space HS to the fitting completion position along the axial direction, and the elastic member 30 supported by the inner wall surface 21*c* of the female connection body 21 surrounding the housing space HS, having the contact point portions (the first contact point portions 30*a*) contacting the outer wall surface 11*d* of the male connection body 11, and pressing the male connection body 11 by the contact point portions 30*a*. The female connection body 21 has the far-side protruding portions 24 protruding from the positions of the inner wall surface 21*c* on the far side in the insertion direction with respect to the contact point portions 30*a*, and the inlet-side protruding portions 25 protruding from the positions of the inner wall surface 21*c* on the inlet side (the first opening 21*a* side) in the insertion direction with respect to the contact point portions 30*a*. The far-side protruding portions 24 and the inlet-side protruding portions 25 support the outer wall surface 11*d* of the male connection body 11 at the fitting completion position against the pressing force of the elastic member 30. The outer wall surface 11*d* of the male connection body 11 has at least one of the first recessed portions 13 formed at the portions facing the inlet-side protruding portions 25 when the male connection body 11 is inserted into the housing space HS or the second recessed portion 16 formed at the portion facing the contact point portion 30*a* when the male connection body 11 is inserted into the housing space HS. The first recessed portions 13 are, at the outer wall surface 11*d* of the male connection body 11, formed along the insertion direction on the front side in the insertion direction with respect to the position facing the inlet-side protruding portion 25 at the fitting completion position. The second recessed portion 16 is, at the outer wall surface 11*d* of the male connection body 11, formed along the insertion direction on the front side in the insertion direction with respect to the position facing the contact point portion 30*a* at the fitting completion position.

The connection terminal 1 according to the embodiment has at least one of the first recessed portions 13 formed at the portions facing the inlet-side protruding portions 25 when the male connection body 11 is inserted into the housing space HS or the second recessed portion 16 formed at the portion facing the first contact point portion 30*a* when the male connection body 11 is inserted into the housing space HS. In a case where the connection terminal 1 according to the embodiment has the first recessed portions 13, when the male connection body 11 is inserted into the housing space HS, the inlet-side protruding portions 25 pass along the first recessed portions 13, and therefore, mechanical interference of the inlet-side protruding portions 25 with the male connection body 11 can be reduced. Moreover, in a case where the connection terminal 1 according to the embodiment has the second recessed portion 16, when the male connection body 11 is inserted into the housing space HS, the first contact point portion 30*a* passes along the second recessed portion 16, and therefore, mechanical interference of the first contact point portion 30*a* with the male connection body 11 can be reduced. When the male connection body 11 is inserted to the fitting completion position, the male connection body 11 is held by the elastic member 30, the far-side protruding portions 24, and the inlet-side protruding portions 25 in the housing space HS. Thus, according to the connection terminal 1 of the embodiment, holding force for holding the male connection body 11 can be ensured while insertion force upon insertion of the male connection body into the housing space of the female connection body can be suppressed low.

In the connection terminal 1 according to the embodiment and the variation, the male connection body 11 has at least the first recessed portions 13, and the first recessed portions 13 are formed in the groove shape along the insertion direction.

Since the first recessed portion 13 is formed in the groove shape along the insertion direction, the first recessed portion 13 can be used as a guide portion configured to guide the inlet-side protruding portion 25. In this case, when the male connection body 11 is inserted into the housing space HS, rotation of the male connection body 11 in the circumferential direction of the inner wall surface 21*c* relative to the female connection body 21 can be restricted by the first recessed portions 13. For example, in a case where the second recessed portion 16 is formed at the male connection body 11, when the male connection body 11 is inserted into the housing space HS, shift of the second recessed portion 16 and the first contact point portion 30*a* from the position at which these portions facing each other can be reduced.

In the connection terminal 1 according to the embodiment and the variation, the male connection body 11 has the first recessed portions 13, and the area of the outer wall surface 11*d* of the male connection body 11 where the first recessed portions 13 are formed includes the positions facing the inlet-side protruding portions 25 when the contact point portions 30*a* start contacting the outer wall surface 11*d* of the male connection body 11 inserted into the housing space HS.

With this configuration, the inlet-side protruding portions 25 are arranged in the first recessed portions 13 when the outer wall surface 11*d* of the male connection body 11 starts contacting the first contact point portions 30*a*. Thus, an increase in the insertion force generated when the male connection body 11 pressed by the first contact point portions 30*a* contacts the inlet-side protruding portions 25 can be suppressed. Thus, the insertion force upon insertion of the male connection body 11 into the housing space HS can be suppressed low.

In the connection terminal 1 according to the variation, the male connection body 11 has the second recessed portion 16, and the second recessed portion 16 is formed to the front end of the outer wall surface 11*d* of the male connection body 11 in the insertion direction. The male connection body 11 receives the pressing force from the first contact point portion 30*a*, and therefore, the insertion force necessary for insertion into the housing space HS increases. The connection terminal 1 according to the variation can delay reception of the pressing force from the first contact point portion 30*a* by the male connection body 11 inserted into the housing space HS. Thus, a period for which the insertion force necessary for inserting the male connection body 11 into the housing space HS increases can be shortened.

The contents disclosed in the above-described embodiment and variation can be implemented in combination, as necessary.

In a connection terminal according to the present embodiments, at least one of a first recessed portion formed at a portion facing an inlet-side protruding portion when a male connection body is inserted into a housing space or a second recessed portion formed at a portion facing a contact point portion when the male connection body is inserted into the housing space is provided. In the connection terminal according to the present invention, insertion force upon insertion of the male connection body into a female connection body is suppressed low by at least one of the first recessed portion or the second recessed portion. Thus, according to the connection terminal of the present invention, an advantageous effect that holding force for holding the male connection body can be ensured while the insertion force upon insertion of the male connection body into the housing space of the female connection body can be suppressed low is provided.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connection terminal comprising:

a tubular female connection body having conductivity and having a housing space extending along an axial direction;

a male connection body having conductivity and inserted into the housing space to a fitting completion position along the axial direction; and an elastic member supported by an inner wall surface of the female connection body surrounding the housing space, having a contact point portion contacting an outer wall surface of the male connection body, and pressing the male connection body by the contact point portion, wherein the female connection body has a far-side protruding portion protruding from a position of the inner wall surface on a far side in an insertion direction with respect to the contact point portion, and an inlet-side protruding portion protruding from a position of the inner wall surface on an inlet side in the insertion direction with respect to the contact point portion, the far-side protruding portion and the inlet-side protruding portion support the outer wall surface of the male connection body at the fitting completion position against pressing force of the elastic member, the outer wall surface of the male connection body has at least one of a first recessed portion formed at a portion facing the inlet-side protruding portion when the male connection body is inserted into the housing space and a second recessed portion formed at a portion facing the contact point portion when the male connection body is inserted into the housing space, the first recessed portion is, at the outer wall surface of the male connection body, formed along the insertion direction on a front side in the insertion direction with respect to a position facing the inlet-side protruding portion at the fitting completion position, and the second recessed portion is, at the outer wall surface of the male connection body, formed along the insertion direction on the front side in the insertion direction with respect to the position facing the contact point portion at the fitting completion position.

2. The connection terminal according to claim 1, wherein the male connection body has at least the first recessed portion, and the first recessed portion is formed in a groove shape along the insertion direction.

3. The connection terminal according to claim 1, wherein the male connection body has at least the first recessed portion, and an area of the outer wall surface of the male connection body where the first recessed portion is formed includes a position facing the inlet-side protruding portion when the contact point portion starts contacting the outer wall surface of the male connection body inserted into the housing space.

4. The connection terminal according to claim 2, wherein the male connection body has at least the first recessed portion, and an area of the outer wall surface of the male connection body where the first recessed portion is formed includes a position facing the inlet-side protruding portion when the contact point portion starts contacting the outer wall surface of the male connection body inserted into the housing space.

5. The connection terminal according to claim 1, wherein the male connection body has the second recessed portion, and the second recessed portion is formed to a front end of the outer wall surface of the male connection body in the insertion direction.

6. The connection terminal according to claim 2, wherein the male connection body has the second recessed portion, and the second recessed portion is formed to a front end of the outer wall surface of the male connection body in the insertion direction.

7. The connection terminal according to claim 3, wherein the male connection body has the second recessed portion, and the second recessed portion is formed to a front end of the outer wall surface of the male connection body in the insertion direction.

8. The connection terminal according to claim 4, wherein the male connection body has the second recessed portion, and the second recessed portion is formed to a front end of the outer wall surface of the male connection body in the insertion direction.

* * * * *